United States Patent [19]

Lundskow et al.

[11] 4,012,277

[45] Mar. 15, 1977

[54] APPARATUS FOR APPLYING THERMOACTIVATABLE ADHESIVE COATED LABELS

[75] Inventors: Luke G. Lundskow; Robert J. Jaarsma; Bobby J. Clay, all of Cincinnati, Ohio

[73] Assignee: Natmar, Inc., Cincinnati, Ohio

[22] Filed: Oct. 14, 1975

[21] Appl. No.: 622,034

[52] U.S. Cl. ..... 156/571; 156/583; 156/DIG. 21; 156/DIG. 31

[51] Int. Cl.[2] ..... B65C 5/04; B65C 9/14; B65C 9/36

[58] Field of Search ..... 156/281, 285, 320, 499, 156/566, 571, 572, 583, DIG. 21, DIG. 31

[56] References Cited

UNITED STATES PATENTS

| | | | |
|---|---|---|---|
| 2,492,908 | 12/1949 | Von Hofe | 156/DIG. 31 UX |
| 2,524,417 | 10/1950 | Bamber | 156/DIG. 31 UX |
| 2,525,741 | 10/1950 | Von Hofe et al. | 156/499 |
| 2,676,726 | 4/1954 | Von Hofe | 156/571 X |
| 3,532,854 | 10/1970 | Sheriff | 156/571 UX |
| 3,660,208 | 5/1972 | Hubbard | 156/571 |
| 3,684,627 | 8/1972 | Hottendorf | 156/566 X |
| 3,711,357 | 1/1973 | Ernst et al. | 156/571 X |
| 3,718,525 | 2/1973 | McGuire et al. | 156/571 X |
| 3,945,878 | 3/1976 | Hubschmitt | 156/DIG. 31 X |
| R23,828 | 5/1954 | Von Hofe | 156/320 |

*Primary Examiner*—Charles E. Van Horn
*Assistant Examiner*—Thomas Bokan
*Attorney, Agent, or Firm*—Wood, Herron & Evans

[57] ABSTRACT

An apparatus of applying labels coated with a thermoactivatable adhesive. The labels are stacked in a magazine, are serially withdrawn by a vacuum picker and deposited on a platform. Each label is transferred from this platform, pressed against a garment, and tacked in place by small area of adhesive on label which is heated during travel. Thereafter, entire label is heated and pressed against garment to effect final bond.

11 Claims, 11 Drawing Figures

APPARATUS FOR APPLYING THERMOACTIVATABLE ADHESIVE COATED LABELS

BACKGROUND OF THE INVENTION

This invention relates to an apparatus for applying labels to garments and similar articles.

In the past, it has been conventional to stitch labels, tags and the like onto garments. More recently, it has become the practice to bond such labels to garments by means of a heat-activated adhesive which is coated upon one surface of the label. This adhesive becomes tacky only when it is heated and is effective when subjected to sufficient heat and pressure to permanently bond the label to the garment.

Various machines have been utilized for use in applying such thermoactivatable, adhesive-coated labels to garments. One conventional machine which is in widespread use includes a stationary lower platen upon which a garment and label are manually placed by the operator. The equipment further includes an upper, heated platen which is connected to the piston rod of a pneumatic cylinder assembly. When the label and garment are positioned, the operator trips a switch to cause the upper platen to be pressed against the garment and label for a predetermined set time. Thereafter, the upper platen is retracted and the garment removed. While this equipment is effective in providing a good bond between the labels and garments, it is not totally satisfactory because of its relatively low production rate. The slow operation is caused in part by the fact that the operator is required not only to position the garment on the platen, but also to select a label and then properly position the label on the garment.

SUMMARY OF THE INVENTION

It is a principal object of the present invention to provide an apparatus for automatically removing a label from a stack and bonding the label to a garment. The operator is only required to place a garment on the platen and remove the garment after the label has been bonded in place.

It is a further object of the present invention to provide a means for applying labels which employs a short cycle time. Thus, the present method and apparatus makes it possible for an operator to label in the order of two to three times as many garments per hour as was possible utilizing prior equipment.

It is a further object of the present invention to provide an apparatus for applying labels which can be used continuously over long periods of time without problems arising from the use of a thermoactivated adhesive. More particularly, in the present apparatus labels are stored in a magazine in which they are isolated from any heated elements so that these labels are not rendered tacky and do not tend to stick together. After a label has been removed from the magazine, it is initially heated in only a small predetermined area to prevent any adhesive from being drawn into any vacuum openings used to hold the label during its transfer. The label is then tacked onto the garment using this small activated-adhesive area, and is thereafter bonded to the garment utilizing platens which do not employ vacuum lines.

More particularly, the present invention is predicated in part upon the concept of automatically securing a label having one surface coated with a thermoactivated adhesive to a garment in a two-step procedure. In the first step, the label is transferred into contact with the garment by a first member which heats a small area of the label during transfer and then tacks the label in place. Thereafter, a second member heats and presses the entire surface of the label against the garment to effect a final bonding.

In one peferred form of machine, labels are stacked on top of one another in a magazine. These labels are formed of any suitable material, such as cloth, and their undersurfaces are entirely coated with a thermoactivatable adhesive. The machine also includes a heated, fixed lower platen over which the operator places a garment to be labeled.

One label is removed in each cycle of operation from the magazine by means of a vertically reciprocating vacuum picker tube which grasps the bottom label and lowers it onto a feed platform. The label is shifted from this platform into contact with the garment by means of a transfer arm which is movable both in a vertical and horizontal direction. The transfer arm includes a series of vacuum openings which grasp the label and a small heater element which heats and activates the adhesive on a section of the label remote from these openings while the label is in transit from the feed table to the garment on the lower platen.

When the transfer arm arrives in a position above the lower platen, it is lowered to momentarily press the label against the garment, whereupon the label is tacked in place at the small tacky area. The vacuum is then removed from the transfer arm and the arm is returned toward its original position while a fresh label is being withdrawn from the magazine. A heated, upper platen is then lowered and forced against the label to thermally activate the entire adhesive surface of the label and to press the label against the garment to form a permanent bond.

One of the advantages of the present apparatus is that the operator need only position a garment on the lower platen and remove the garment after the label has been applied. The remaining operations of the machine are entirely automatic and require no manual dexterity on the part of the operator. Moreover, the cycle time of the machine is minimal so that the labels can be applied at a high rate of speed.

It is a further advantage of the present invention that even after periods of continuous use, the machine does not malfunction due to the accumulation of adhesive in the vacuum lines or to the heating or the sticking together of labels in the magazine due to inadvertent heating thereof.

DETAILED DESCRIPTION OF A PREFERRED EMBODIMENT

Figure 1:
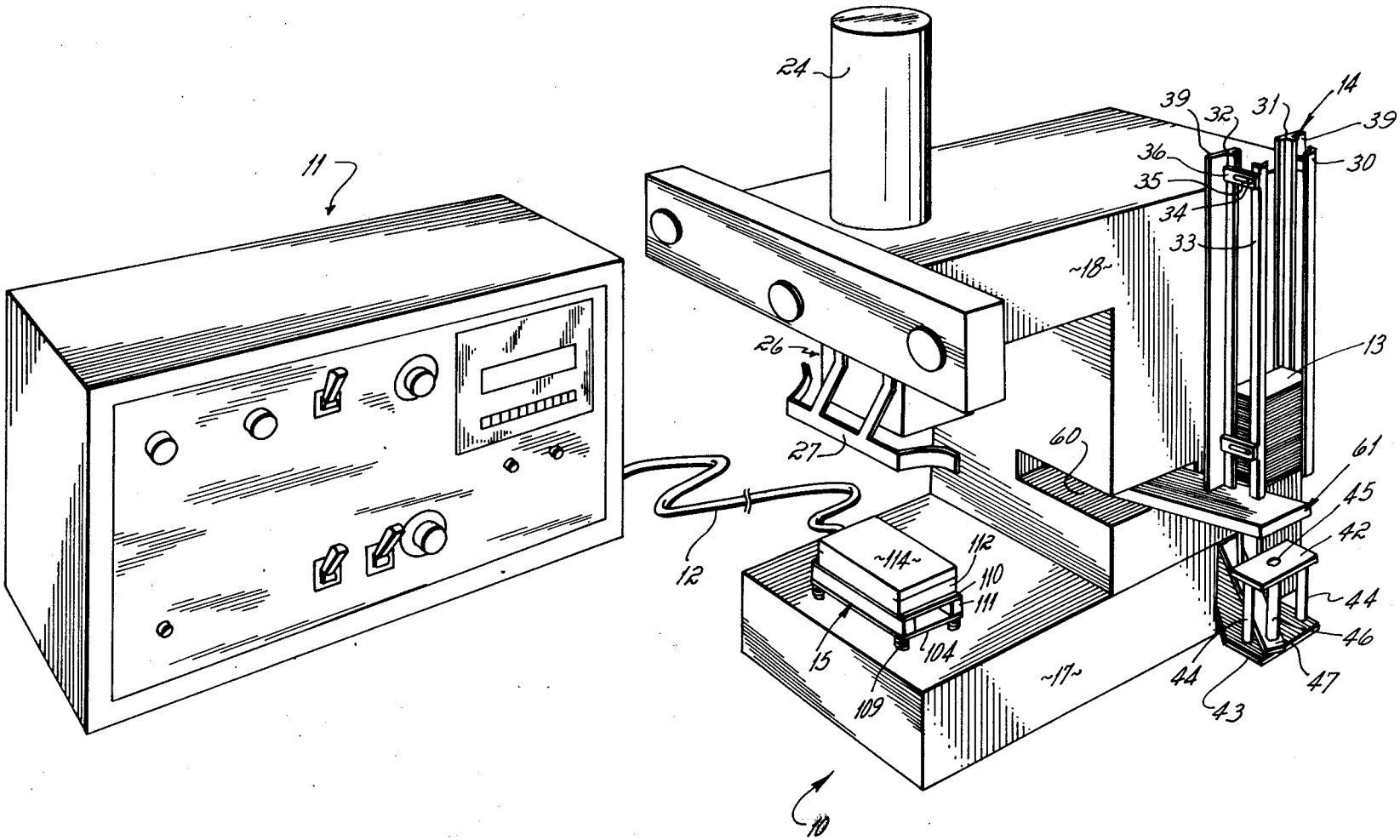
FIG. 1 is a perspective view of a label-applying apparatus embodying the principles of the present invention.

The overall construction of one preferred form of a label-applying apparatus embodying the present invention is shown in FIG. 1. As there shown, a label-applying machine 10 is utilized in connection with a control unit 11 which can be located in any convenient place and is interconnected therewith by a control cable 12. As is explained in greater detail below, the present label-applying apparatus 10 is effective to automatically remove one of the thermoactivatable adhesive-carrying labels 13 from a magazine 14, and to transfer the label to a position over a stationary platen 15 while simultaneously heating a small area of the label to activate the adhesive. Thereafter, the machine is effective to force the label against a garment held on the platen so that the label is "tacked" in place. Finally, the machine permanently affixes the label to the garment by forcing a heated platen against the label to actuate the adhesive covering the entire label and to permanently bond the label to the garment.

It is to be understood that while the present invention is described in relation to the application of labels, it can also be used equally well to apply emblems, patches, tags, and similar items, comprising a sheet of cloth, or the like, having one surface coated with a heat-activatable adhesive.

Figure 4:
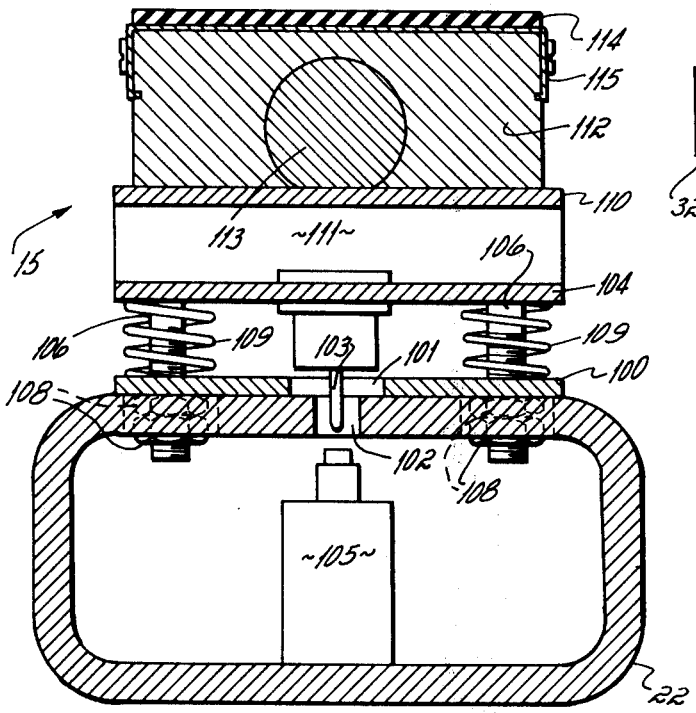
FIG. 4 is a cross-sectional view taken along line 4—4 of FIG. 2.

The label-applying apparatus 10 includes a base 16 which supports various components of the apparatus as well as lower cover section 17 and upper cover section 18. One member which is affixed to the base is an upright column 20. This column carries at its upper end a horizontal upper arm 21, and adjacent to its lower end, a lower arm 22. Each of the upper arms is preferably in the form of a generally rectangular tube as illustrated in FIG. 4. The rear section of each arm is bifurcated and includes a circular opening surrounding column 20. The two split sections of each arm drawn together as by means of a draw bolt and nut 23 to hold the arms in position upon the post. The outermost portion of lower arm 22 carries lower platen assembly 15. The upper arm carries a pneumatic head cylinder 24 which receives a piston having an attached piston rod 25, the lower end of which carries an upper platen assembly 26 and guard 27.

As is explained in detail below, both upper and lower platens 15 and 26 are heated. These platens are disposed in vertical alignment so that when an article and label are placed on lower platen 15 and pneumatic pressure is applied to head cylinder 24, piston rod 25 is advanced downwardly to force upper platen 26 against the label and garment so that heat and pressure can be applied to the label for a predetermined time to thermally activate the adhesive by the label and cause the label to be permanently secured to the garment.

It is to be understood that in the embodiment shown, an operator manually positions a garment over lower platen 15, although it is contemplated that the machine could be equipped with an automatic garment feed if desired. Such a garment feed does not, however, constitute any part of the present invention.

Figure 6:
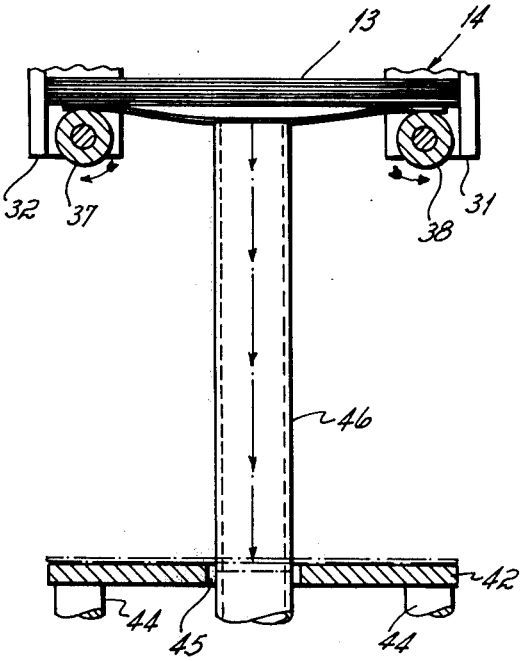
FIG. 6 is a vertical cross-sectional view taken through the lower portion of the label magazine and feed platform.
Figure 5:
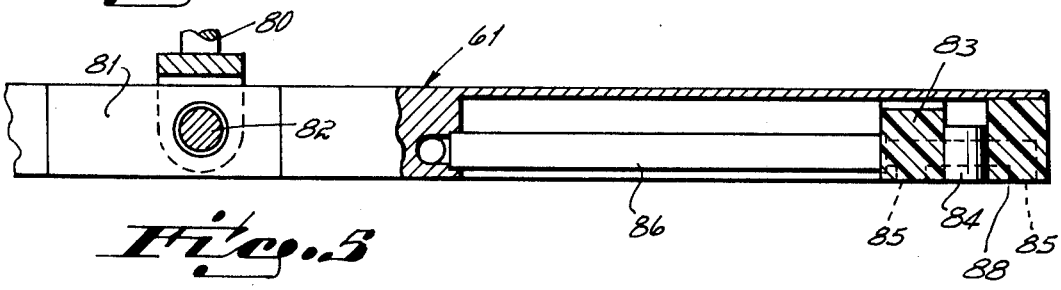
FIG. 5 is a cross-sectional view taken along line 5—5 of FIG. 3.

In addition to these elements, the present apparatus includes a label magazine 14, the construction of which is illustrated in FIGS. 1 and 6. Magazine 14 is adapted to hold a stack of superposed pre-cut labels 13. The complete undersurface of each of these labels is preferably coated with a thermoactivatable adhesive. Many suitable adhesives are well-known in the art. They are normally not tacky, but become so when they are heated. Such adhesive is effective to bond a label to a garment when the label is held in contact with the garment at an elevated temperature and pressure for a predetermined time.

The magazine 14 includes four upright angle members 30–33. The angle members are adjustably positioned relative to one another to accommodate different size labels. Thus, the front angle members 30 and 33 can be shifted in and out relative to the rear angle members 31 and 32 by means of bolts 34 secured to the front angle members and in engagement with elongated slots 35 provided in stationary brackets 36 carried by the rear angle members. The sideways spacing between the leftmost pair of angle members and the rightmost pair of angle members can also be adjusted in any suitable manner, for example, by adjustably positioning the spacing between the rear arms 39 of angle members 31 and 32, one of these arms being mounted for relative movement as by means of bolts secured in horizontal slots (not shown) in cover 18. At the lowermost end of each side of magazine 14 is mounted a freely rotatable roller 37 and 38. The rollers, as best shown in FIG. 6, are mounted upon parallel shafts and define a downward discharge opening of a length less than the length of a label 13.

The magazine 14 is mounted directly above a feed platform 42. This feed platform is stationary and is mounted upon an extension 43 of the base as by means of two spacing rods 44, the upper ends of which are topped and secured in place by means of screws **44*a*, and the heads of which are countersunk to be flush with the surface of the feed platform. The center of the feed platform is provided with an aperture 45 which receives a pick arm 46.**

The pick arm is vertically reciprocal between a lower position, in which the upper end of the pick arm is substantially flush with feed platform 42 (FIG. 1), and an upper position, in which the upper edge of the pick arm engages the lowermost label 13 in magazine 14, as shown in FIG. 6. The pick arm is hollow and is connected to a vacuum line 49. The pick arm is mounted upon a support arm 47 which is in turn secured to the rod 50 of a piston (not shown) disposed within pick cylinder 51.

The pick cylinder 51 is stationary and is mounted upon a plate 52 which is in turn bolted, or otherwise secured, above and in spaced relationship to base 16. Support arm 47 is guided in part by a rod 53 carried by the support arm and extending upwardly through an opening in plate 52.

When the pick arm is raised into contact with the lowermost label 13 in magazine 14 and vacuum is applied to line 49, the pick arm grasps the label. Then as the pick arm is lowered, the lowermost label is drawn downwardly between rollers 37 and 38 as shown in FIG. 6. The remaining labels are supported by the rollers and are thus retained in the magazine. It is to be understood that pick arm 46 is not heated.

Figure 3:
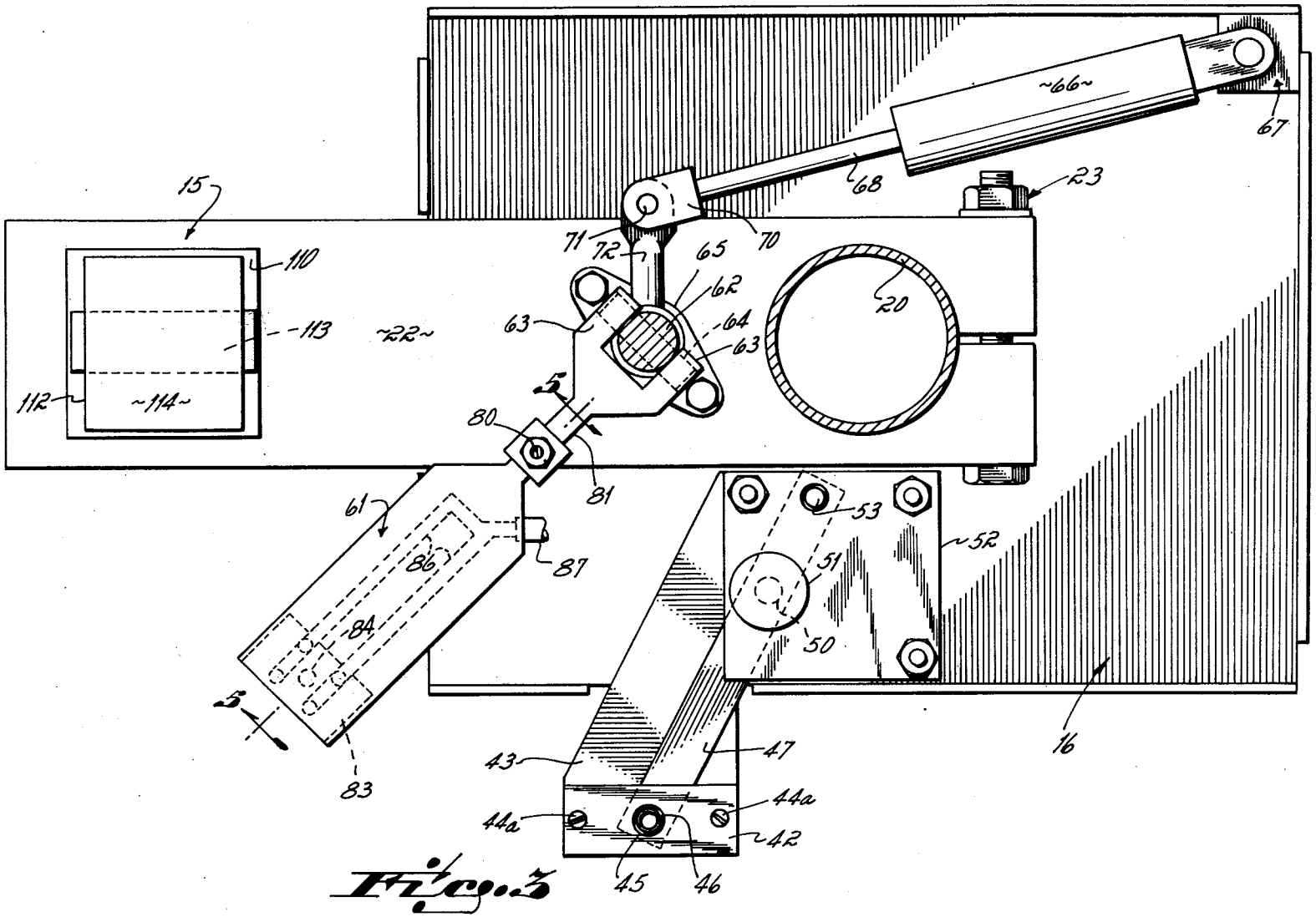
FIG. 3 is a cross-sectional view taken along line 3—3 of FIG. 2.

As shown in FIG. 1, upper cover section 18 has a 90° horizontal slot 60 formed in its front and side walls for permitting horizontal swinging movement and vertical pivoting movement of a transfer arm 61. The transfer arm 61 is carried by a vertical shaft 62. As shown in FIG. 3, the inner end of the transfer arm is of a yoke configuration including two spaced portions 63 which are disposed on opposite sides of the shaft 62 and receive a pin 64 which extends through the arms and through shaft 62. By means of this arrangement, the transfer arm is mounted for rotation in a horizontal plane with rotation of shaft 62. In addition, the arm 61 is free for pivotal movement in a vertical plane about pin 64. Shaft 62 is supported in upper and lower journal bearings 65. Lower journal bearing 65 is shown in FIG. 3 and is bolted or otherwise secured to lower arm 22, the upper journal bearing being similarly secured to the undersurface of the upper arm 21.

Shaft 62 and arm 61 are rotated by means of a rotation cylinder 66 which is mounted upon base 16 as at 67. Pneumatic cylinder 66 carries a piston having an associated rod 68. This rod carries a yoke 70 which is rotatably connected by pins 71 to an arm 72 rigidly secured to shaft 62. Thus, advancing and retracting movements of the piston rod 68 are effective to cause rotation of shaft 62 and a similar rotation of arm 61.

Figure 2:
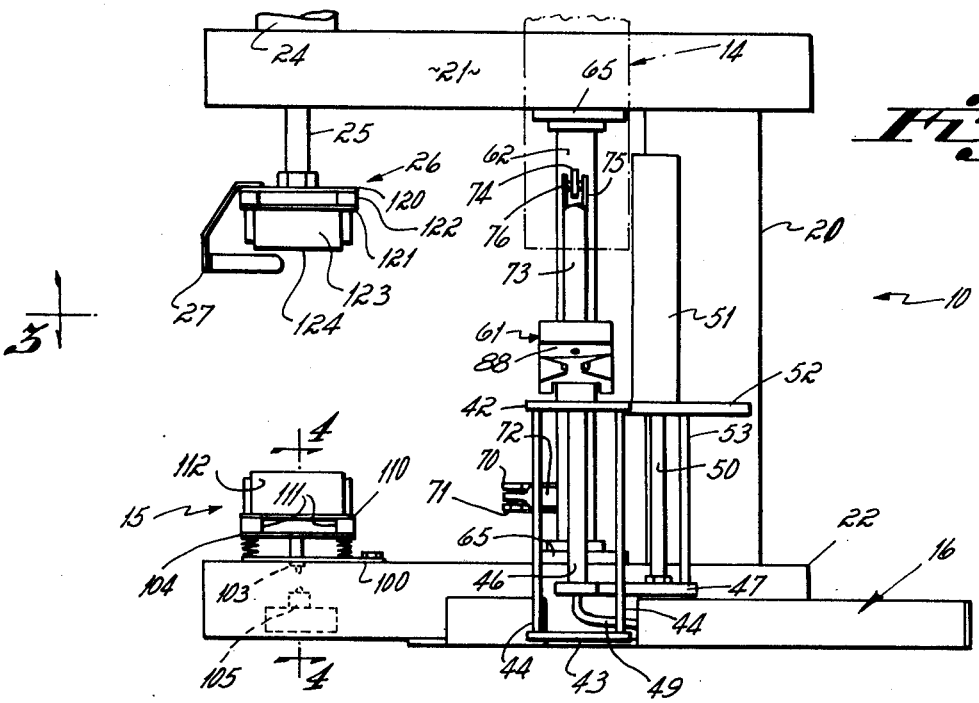
FIG. 2 is a side elevational view of the label-applying apparatus with the cover removed.

Vertical movement of transfer arm 61 is controlled by means of a pneumatic feed cylinder 73 which is carried by a bracket 74 mounted upon shaft 62. As shown in FIG. 2, the upper end of cylinder 73 carries straps 75 which are pivotally secured to bracket 74 by means of a pin 76.

Cylinder 73 houses a piston (not shown) having a piston rod 80 which is pivotally connected to an intermediate web portion 81 of the transfer arm 61 by means of pin 82. Thus, retraction of the piston within cylinder 73 causes arm 61 to be lifted, while advancement of the piston causes arm 61 to be lowered.

The outmost end of the transfer arm carries a downwardly facing pad 83 preferably formed of Teflon, or the like. This pad is provided with a central electric resistance heating element 84 and has spaced therefrom a plurality of vacuum openings 85 connected through conduits 86 to a vacuum line 87. The spacing of openings 85 from heating element 84 is sufficient so that the adhesive area of a label 13, which is rendered tacky by element 84, does not extend to the openings and, hence, no adhesive is drawn into the openings to clog the vacuum line.

It is to be understood that the length of arm 61 is such that when the arm is positioned over feed platform 62 and is lowered, block 83 is disposed in registry with the platform with the lower face 88 of the block parallel to the surface of the platform. With the transfer arm in this position, the vacuum holes 85 are disposed in contact with a label so that when a vacuum is applied to the arm, a label is held tightly against pad 83. At the same time, heater element 84 is effective to heat a circular area in the center of the label which is spaced from the vacuum apertures 85 so that the adhesive, which is softened by the heating element, is not drawn into the vacuum apertures.

Lower platen assembly 15 is spaced outwardly along lower arm 22 a sufficient distance so that when arm 61 is rotated to a position over the lower platen and is lowered, block 83 is disposed directly above platen and is parallel with its upper surface.

The details of lower platen assembly 15 are best shown in FIG. 4. More particularly, the lower platen assembly comprises a support plate 100 which is bolted to lower arm 22. The support plate includes a central aperture 101 which registers with an aperture 102 provided in the upper wall of the lower arm. These apertures provide clearance for a switch actuator 103 carried by lower plate 104. The switch actuator 103 is positioned to actuate switch 105 when the lower platen assembly is depressed in response to the lowering of the upper platen assembly.

Lower plate 104 supports at each of its corner a stud 106. These stud extend downwardly through openings in support plate 100 and openings in arm 22. The lower end of studs 106 carry nuts 108 which are adjusted to limit upward travel of the platen through their engagement with plate 100. The platen is spring-urged upwardly by means of coil springs 109 which loosely surround each of the studs.

Lower plate 104 carries an upper plate 110 which is spaced from the lower plate and is supported by two insulating bars 111. Upper plate 104 carries a metal heat-transmitting block 112 which encloses an electric heating element 113 of any suitable type, such as a cast in Cal-Rod. The upper surface of block 112 is faced with a sheet of Teflon 114, or the like, held in place by a clamp 115. It is to be understood that the face of the lower platen is larger than the label 13.

The construction of the upper platen is generally similar to that of the lower platen, except that the upper platen is rigidly mounted to the lower end of piston rod 25. More particularly, the upper platen includes spaced plates 120 and 121 which are interconnected by insulating blocks 122. The upper plate 120 is secured in any suitable manner to the lower end of piston rod 25. Lower plate 121 carries a heat-transmitting block 123 which encloses an electric heating element, such as a cast in Cal-Rod (not shown). The lower face of the upper heating element is covered by a sheet 124 of Teflon, or the like.

It is to be understood that when piston rod 25 is extended upon downward actuation of the piston in head cylinder 24, the upper platen is shifted toward the lower platen with the opposing platen faces in parallel alignment. When a garment and label are placed over the lower platen and the upper platen is advanced, it is effective to heat the entire lower label and apply a pressure across its entirety, which pressure is controlled by controlling the air pressure admitted to head cylinder 24. It will be appreciated that when the upper platen presses against the label and garment, the lower platen is forced downwardly against the force of springs 109.

The temperature and pressure controls for the various components of the machine and the sequencing controls are of standard construction and are well-known in the art. It is contemplated that the sequencing controls can be of either an electrical or pneumatic type. In any event, the exact nature of these controls constitutes no part of the present invention.

In setting up the machine for operation, the operator utilizes the control panel 11 shown in FIG. 1. In the first place, the pneumatic pressure which is supplied to the various cylinders is set. Secondly, the heat-set time, i.e., the length of time the upper platen remains in contact with the work after the depression of switch 105, is set. This time is established in accordance with the nature of the adhesive used and the types of material being joined. Thereafter, the upper and lower platen temperatures are set, and these heaters and the heating element carried by transfer arm 61 are energized. A supply of labels is loaded into hopper 14 with the adhesive-coated surfaces of the labels facing downwardly.

After the heaters have had sufficient time to heat up, a start button is depressed to cycle the equipment. During the first cycle, no label is transferred by transfer arm 61. However, a label is withdrawn from the magazine by picker tube 46 and deposited upon the feed platform 42.

Figure 7:
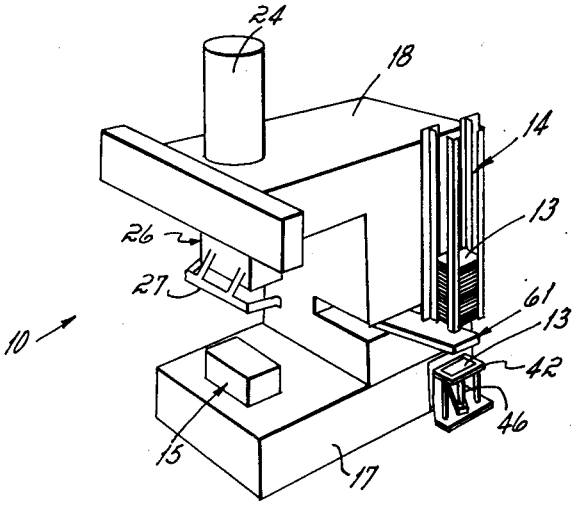
FIG. 7 is a perspective view of the label-applying machine at the start of a cycle of operation.
Figure 7A:
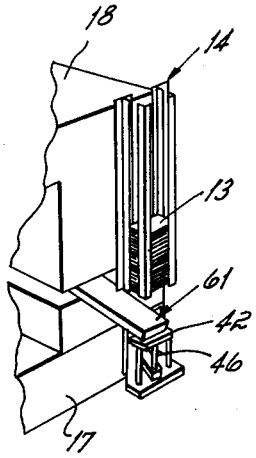
FIG. 7A is a partial view of the apparatus shown in FIG. 7 showing the transfer arm in the process of picking up a label from the feed platform.
Figure 8:
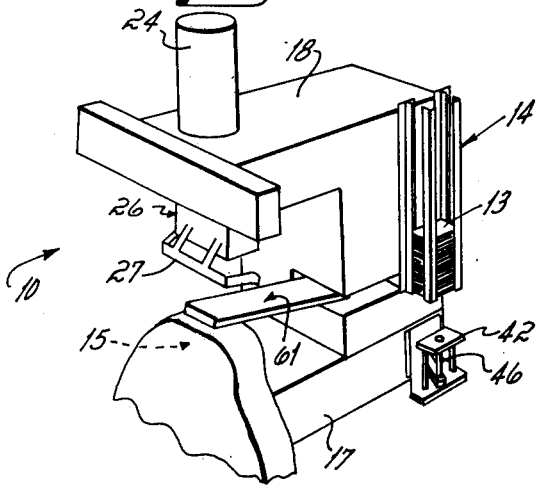
FIG. 8 is a view of the apparatus shown in FIG. 7 showing the transfer platen depositing a label upon an article positioned over the stationary lower platen.
Figure 9:
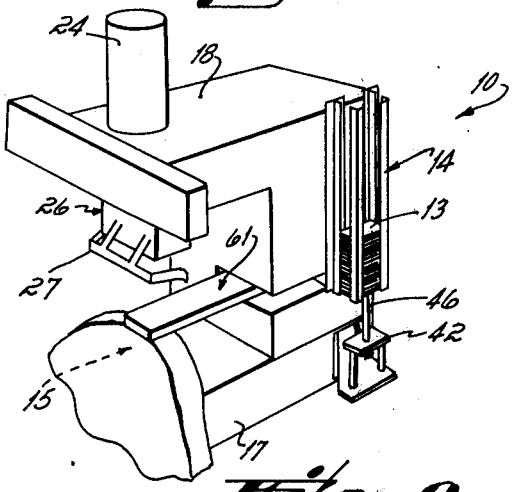
FIG. 9 is a view of the apparatus shown in FIG. 8 showing the pick arm removing a label from the magazine.

At the start of the second and all subsequent cycles, the machine elements are positioned as shown in FIG. 7. More particularly, a label is positioned on the feed platform 42. The label is held in position by the vacuum applied to line 49 and, hence, to pickup tube 46. As the cycle of operation commences, transfer arm 61 is positioned between the lowermost portion of magazine 14 and platform 42. The initial movement of transfer arm 61 is downwardly in a vertical direction. This movement is effected by causing the piston associated with cylinder 73 to be extended, lowering arm 61 so that the pad 83 carried by the arm is brought into contact with the label 13 mounted on platform 42. As the arm is lowered, a vacuum is applied to openings 85 of the transfer arm. The label 13 is thus held tightly against pad 83 while a center portion of the label is heated by contact with heater element 84.

In the next step, the transfer arm is elevated by retracting the piston in cylinder 73 and is rotated by extending the piston in a cylinder 66 to a position in which it is spaced above lower platen 15. It is to be understood that prior to the movement of arm 61, the operator has manually pressed a garment over the lower platen with the portion of the garment adapted to receive label 13 facing upwardly.

In the next step, the arm 61 is lowered to press label 13 against the exposed portion of the garment above lower platen 15. Vacuum is removed from the pick arm openings 85 to release the label. It is to be understood that during the transfer of the label from platform 42 to a position in contact with the garment, heater element 84 is effective to heat a center spot on the label to render tacky that portion of the label in registry with the heater element. Thus, label 13 is tacked to the garment by this small activated-adhesive area.

At the same time that the transfer arm 61 is rotated from the feed platform 42 to a position above the lower platen 15, pick arm 46 is elevated into contact with the lowermost label 13 in magazine 14. This vertical movement of the pick arm is effected by retracting the piston within cylinder 51. When vacuum is released from transfer arm 61, it is applied to the feed tube 46 causing that tube to grasp the lowermost label 13 in contact therewith.

Figure 10:
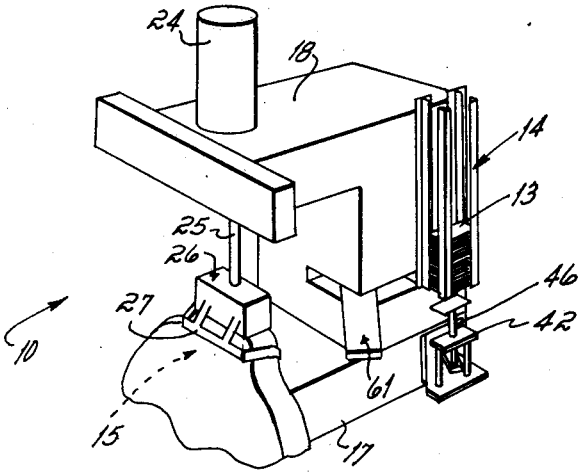
FIG. 10 is a view of the apparatus shown in FIG. 8 showing the pick arm shifting the label toward the feed platform while the transfer arm is being returned to its starting position.

Thereafter, transfer arm 61 is raised by retraction of the piston within cylinder 73 and is rotated by action of the piston within rotation cylinder 66 back toward its start position above feed platform 42. Simultaneously, the feed cylinder 46 is lowered to bring a new label into position on the feed platform. These latter two movements are illustrated in FIG. 10.

As the transfer arm returns to its start position, head cylinder 24 is pressurized to force the upper platen 26 down into engagement with the lower platen 15. This movement actuates switch 105 and starts the timer which regulates the length of time the platens are held in clamping engagement with the label and garment. During this period of engagement, the adhesive on the entire surface of the label is heated and activated so that the adhesive forms a permanent bond between the label and garment. At the conclusion of the selected time interval, the upper platen is raised so that the machine is again in its starting position as shown in FIG. 7 and a new cycle is commenced.

While the cycle time obviously depends in part upon the set time required to effect a bond between the label and garment, the present equipment can operate very rapidly, for example, with a total cycle time of approximately 4 seconds. Moreover, the equipment can be operated over long periods without difficulty from labels sticking together in the magazine or adhesive fouling the vacuum lines. More particularly, pick arm 46 is not heated so that the labels in the magazine 14 are not subjected to any heat which would cause them to tend to stick together. Moreover, the areas of the label brought into contact with pick tube 46 are not rendered tacky and there is no tendency of any adhesive to be drawn into the vacuum line connected to this tube. Furthermore, only the area of the label adjacent to small heater element 84 is rendered tacky during the transfer of the label by arm 61. This small area of tacky adhesive is remote from the vacuum openings 85 so that again no adhesive is drawn into the vacuum lines. However, this small activated-adhesive area is effective to tack the label to the garment so that it is held in position while transfer arm 61 is removed and the upper platen is lowered into contact with the label to effect the final bonding.

From the above disclosure of the general principles of the present invention and the above description of a preferred embodiment, those skilled in the art will readily comprehend various modifications to which the invention is susceptible. Therefore, we desire to be limited only by the scope of the following claims.

Having described our invention, we claim:

1. In apparatus for applying to an article a label of the type having a thermoactivatable adhesive coated on one side thereof, the combination of:

a first platen for supporting said article;

a second platen;

means having at least one of said platens;

a label support disposed remote from said platens;

a transfer arm adapted for movement from a position adjacent said label support to a position adjacent to said first platen;

vacuum conduit means carried by said transfer arm for applying a vacuum to one area of a label;

heating means carried by said transfer arm for heating a second area of said label remote from said first to thermally activate an area of said adhesive;

means for shifting said transfer arm from a position in contact with a label on said support to bring said label into contact with an article on said first platen, whereby said label is tacked to said article;

means for shifting said transfer arm away from said first platen; and means for forcing one of said platens against the other to apply heat and pressure to said label and article to effect a bond therebetween.

2. The apparatus of claim 1 in which said transfer arm is rotatable in a horizontal plane and shiftable in a vertical plane.

3. The apparatus of claim 2 in which said transfer arm is carried by a vertically disposed rotatable shaft and is pivotally secured thereto for vertical swinging movement;

and said means for shifting said transfer arm comprises a first pneumatic cylinder assembly for rotating said shaft and a second pneumatic cylinder assembly carried by said shaft and connected to said arm for raising and lowering said arm.

4. The apparatus of claim 1 in which said transfer arm carries a pad adjacent to the free end of said arm, said pad having a plurality of spaced vacuum openings formed therein, and a heater element disposed remote from said openings.

5. In apparatus for applying to an article a label of the type having a thermoactivatable adhesive coated on one side thereof, the combination of:

a lower platen for supporting said article;

an upper platen;

means heating at least one of said platens;

a magazine for supporting a stack of labels in superposed relationship remote from said platens;

a label support platform;

picker means for serially removing said labels from said magazine and depositing them on said platform;

a transfer arm adapted for movement from a position adjacent said label support platform to a position adjacent to said lower platen;

vacuum conduit means carried by said transfer arm for applying a vacuum to one area of a label;

heating means carried by said transfer arm for heating a second area of said label remote from said first to thermally activate an area of said adhesive;

means for shifting said transfer arm from a position in contact with a label on said platform to bring said label into contact with an article on said lower platen, whereby said label is tacked to said article;

means for shifting said transfer arm away from said lower platen; and means for forcing one of said platens against the other to apply heat and pressure to said label and article to effect a bond therebetween.

6. The apparatus of claim 5 in which said transfer arm is rotatable in a horizontal plane and shiftable in a vertical plane.

7. The apparatus of claim 6 in which said transfer arm is carried by a vertically disposed rotatable shaft and is pivotally secured thereto for vertical swinging movement;

and said means for shifting said transfer arm comprises a first pneumatic cylinder assembly for rotating said shaft and a second pneumatic cylinder assembly carried by said shaft and connected to said arm for raising and lowering said arm.

8. The apparatus of claim 5 in which said transfer arm carries a pad adjacent to the free end of said arm, said pad having a plurality of spaced vacuum openings formed therein, and a heater element disposed remote from said openings.

9. The apparatus of claim 5 in which said magazine is vertically disposed and is mounted above and spaced from said label support platform;

and said picker means comprises a vacuum member effective to engage the lowermost label in said magazine and transfer said label onto said platform.

10. The apparatus of claim 9 in which said picker means is a vacuum tube, said platform including an opening receiving said tube, and said apparatus further comprises:

means for reciprocating said tube between a position in which said tube engages the label in said magazine and a position in which the uppermost portion of said tube is retracted within the opening in said platform.

11. The apparatus of claim 10 in which said magazine includes a discharge opening and two parallel spaced rollers adjacent said discharge opening, said rollers supporting the ends of the lowermost label in said magazine.

* * * * *

UNITED STATES PATENT OFFICE

CERTIFICATE OF CORRECTION

PATENT NO. : 4,012,277

DATED : March 15, 1977

INVENTOR(S) : Luke G. Lundskow et al

It is certified that error appears in the above-identified patent and that said Letters Patent are hereby corrected as shown below:

Column 3, line 54 after "arm" insert --are--.

Column 6, line 6 after "above" insert --the lower--; line 19 "corner" should be --corners--; line 20 "stud" should be --studs--; line 29 "104" should be --110--.

Column 8, line 53 "having" should be --heating--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*